United States Patent [19]

Brown

[11] Patent Number: 4,506,408

[45] Date of Patent: Mar. 26, 1985

[54] RATCHET HINGE STRUCTURE

[76] Inventor: Dwight C. Brown, 1516 N. Nicholas St., Arlington, Va. 22205

[21] Appl. No.: 523,950

[22] Filed: Aug. 17, 1983

Related U.S. Application Data

[63] Continuation-in-part of Ser. No. 428,637, Sep. 30, 1982, abandoned.

[51] Int. Cl.[3] ..... E05D 11/08; E05D 3/02

[52] U.S. Cl. ..... 16/225; 16/239; 16/242; 16/342; 16/386

[58] Field of Search ..... 16/225, 236, 239, 242, 16/265, 271, 272, 355, 386, DIG. 13, 337, 342, 344, 347, 350

[56] References Cited

U.S. PATENT DOCUMENTS

| | | | |
|---|---|---|---|
| 7,831 | 8/1877 | Bradley | 16/253 X |
| 595,789 | 12/1897 | Smith | 256/26 |
| 1,044,055 | 11/1912 | Johnson et al. | 16/242 X |
| 1,759,237 | 5/1930 | McClure | 16/342 |
| 2,872,697 | 2/1959 | Hizsa, Jr. | 16/342 |
| 3,000,049 | 9/1961 | Terry, Jr. | 16/386 X |
| 3,268,946 | 8/1966 | Case | 16/253 |

FOREIGN PATENT DOCUMENTS

| | | | |
|---|---|---|---|
| 2520305 | 11/1976 | Fed. Rep. of Germany | 16/239 |
| 1484129 | 8/1977 | United Kingdom | 16/350 |

*Primary Examiner*—Fred Andrew Silverberg
*Attorney, Agent, or Firm*—Parkhurst & Oliff

[57] ABSTRACT

The present invention relates to a structurally uncomplicated, lightweight and inexpensive variable position hinge structure. The hinge structure comprises a male component, a portion of which comprises a relatively raised and non-raised portion, and a female component, a portion of which comprises a relatively raised and non-raised portion. The raised and non-raised portions of the male and female components mesh to lock the male and female components relative to each other at various positions of rotation therebetween.

12 Claims, 22 Drawing Figures

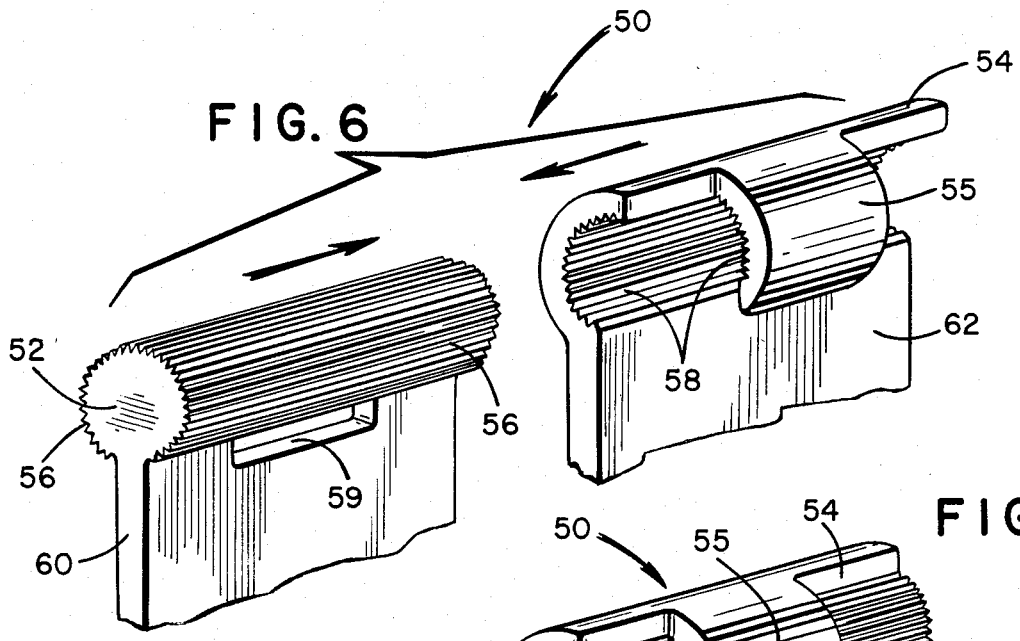
FIG. 6
FIG. 7
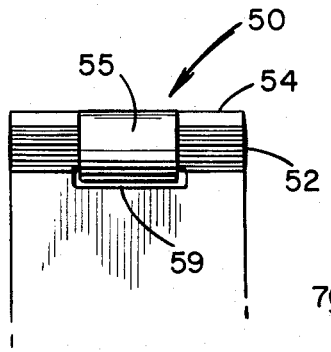
FIG. 8
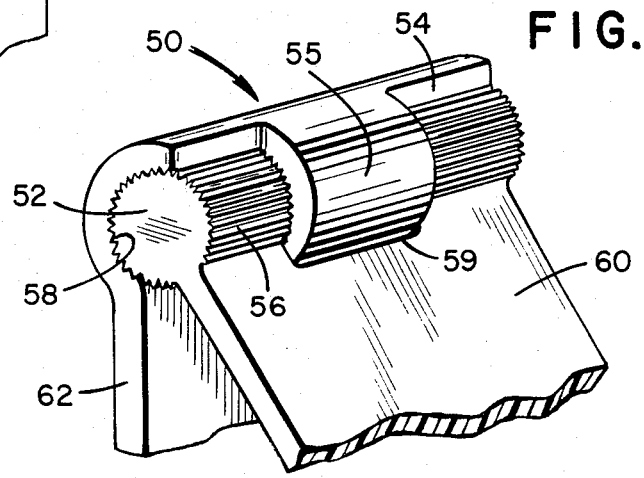
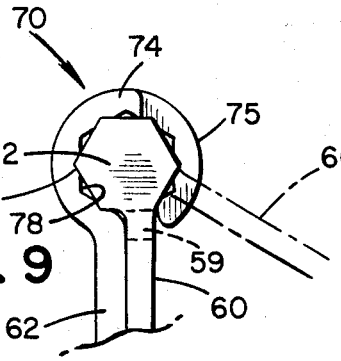
FIG. 9
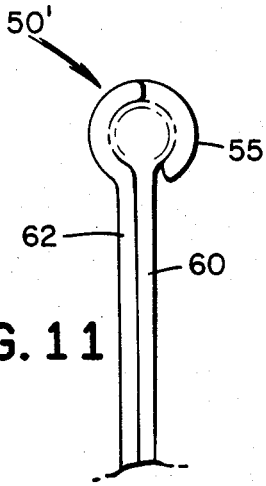
FIG. 11
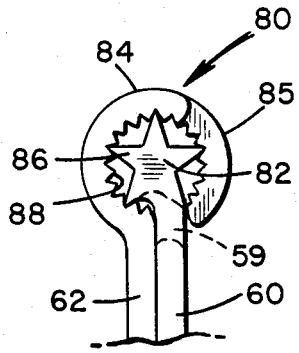
FIG. 10
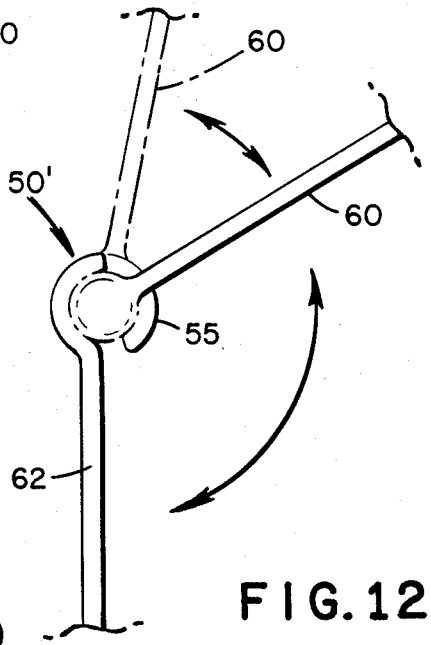
FIG. 12

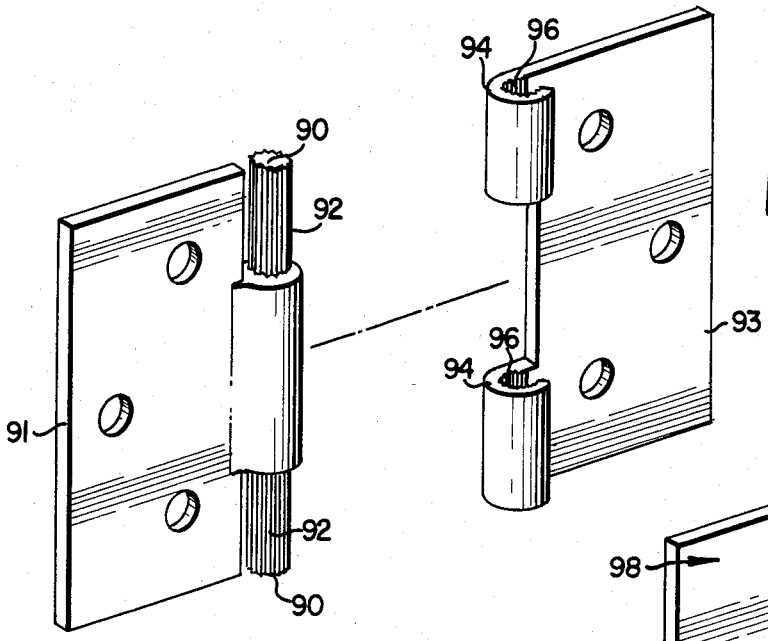
FIG. 13
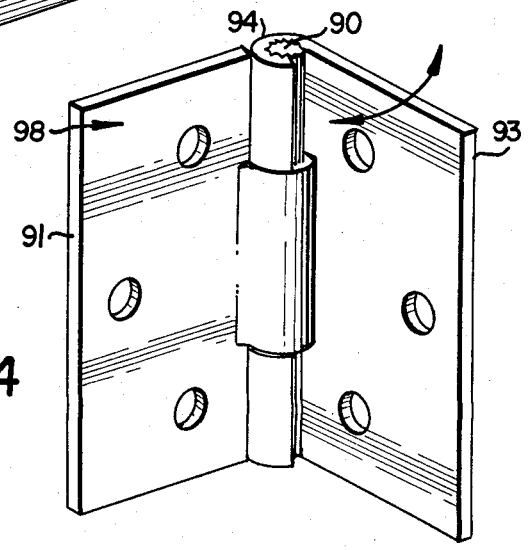
FIG. 14
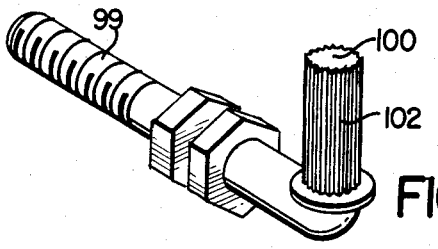
FIG. 15
FIG. 17
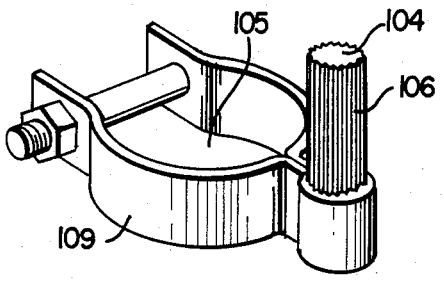
FIG. 16
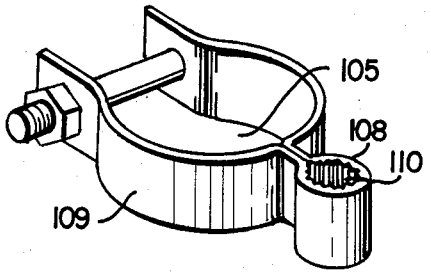

RATCHET HINGE STRUCTURE

This application is a continuation-in-part from U.S. application Ser. No. 428,637, filed Sept. 30, 1982, now abandoned.

BACKGROUND OF THE INVENTION

This invention relates to a structurally uncomplicated hinge structure having variable position settings to allow the members hinged together to be positioned at many different positions relative to each other.

Traditionally, simple hinge structures have had two settings in which the hinged members are secured relative to each other, a first setting in which the hinged members were locked in a position closest to each other and a second setting in which the hinged members are locked in a position furthest from each other. The traditional hinge structures allowed movement between these two settings. However, there was no means to lock the two members in variable positions relative to each other between the first and second settings.

Attempts to develop hinges with variable position setting have often resulted in complex, cumbersome and expensive structures.

The present invention provides a variable position hinge which is structurally uncomplicated, lightweight and economical.

BRIEF DESCRIPTION OF THE DRAWINGS

FIG. 6 is an exploded view of a hinged structure designed to provide wide separation of the hinged members;

FIG. 7 is an assembled view of the structure seen in FIG. 6;

FIG. 8 is a front view of the assembled fastener seen in FIG. 7;

FIG. 9 is a modified view of the hinge assembly;

FIG. 10 is modified view of the hinge assembly;

FIG. 11 is a view showing movement of a hinged assembly according to the present invention;

FIG. 12 is a view showing movement of a hinged assembly according to the present invention;

FIG. 13 is an exploded view of a door hinge incorporating the hinge movement of the present invention;

FIG. 14 is an assembled view of the door hinge seen in FIG. 12;

FIG. 15 is the male component of a gate hinge incorporating the hinge structure of the present invention;

FIG. 16 is a female component of a gate hinge incorporating the hinge structure of the present invention; and FIG. 17 is a view of another type male component of a gate hinge incorporating the hinge structure of the present invention.

DESCRIPTION OF PREFERRED EMBODIMENTS

Figure 1:
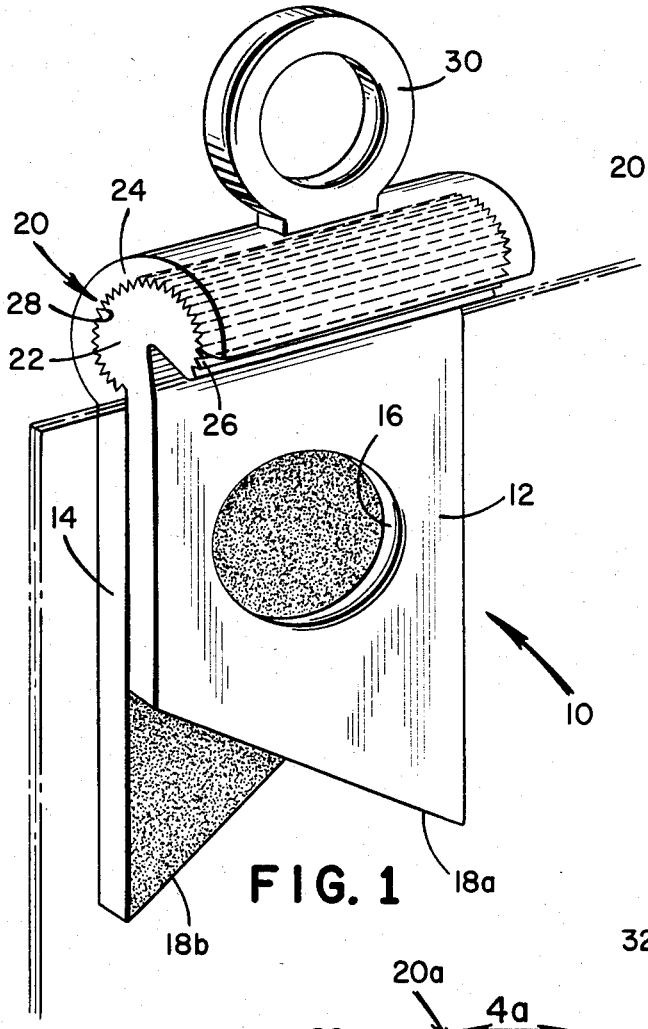
FIG. 1 is perspective view of an assembled fastener incorporating the hinge design of the present invention.
Figure 2:
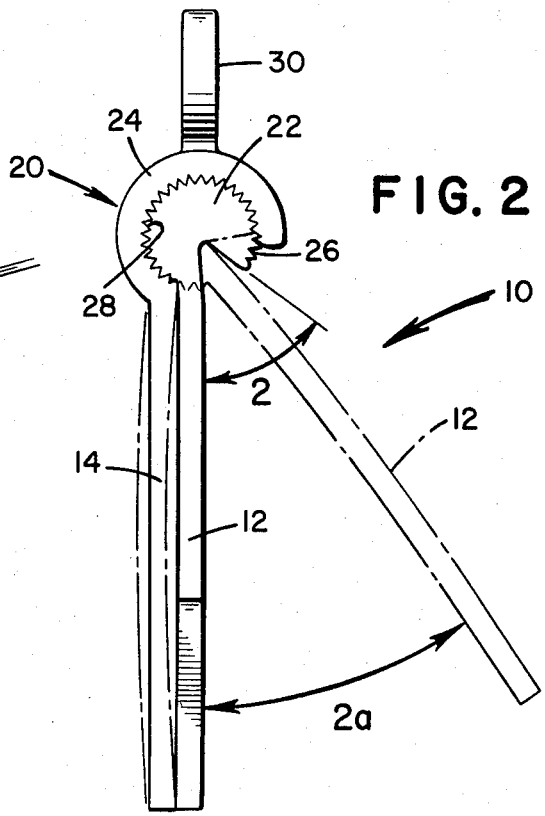
FIG. 2 is a side elevation of the fastener of FIG. 1 showing movement of the hinge structure.

Referring to FIG. 1 of the drawings, a hanger with a fastener incorporating the variable position hinge structure according to the present invention is shown. The hanger 10 is hung by eyelet 30 and members 12 and 14 of the fastener are closed together to secure an article therebetween. The variable position hinge structure of the present invention comprises two main components, a female component 24 and a male component 22. Relative movement of components 22 and 24 will effect relative movement of members 12 and 14 which are extensions of components 22 and 24, respectively. As member 12 is moved relative to member 14, as in FIG. 2, articles may be removed or inserted therebetween. When the fastener is in a closed position, as in FIG. 1, the article is pressed between frictionally engaging surfaces 18*a* and 18*b* of members 12 and 14 respectively and held securely.

Members 12 and 14 may be held together or apart or at many different positions therebetween by the meshing of ribs and grooves 28 of the female component 24 and ribs and grooves 26 of male component 22. This meshing serves to securely position members 12 and 14 at desired positions relative to each other. The number of relative positions is limited only to the number of meshing combinations of the male and female components. Rotational movement of the ribs and grooves relative to each other to effect movement of members 12 and 14 relative to each other is achieved by overcoming the structural integrity and frictional engagement of the meshed ribs and grooves. To make this possible, one or both sets of ribs and grooves 26 and 28 is made of a resilient material, such as plastic, which will deform to permit rotation between ribs 26 and 28 when a sufficient rotational force is applied to overcome the opposing forces of structural integrity and frictional engagement. The ribs will be deformed through each period of rotation in which ribs and grooves 26 and 28 do not align. The resilient ribs will spring back to their original shape and dimension at each rotational position at which the ribs and grooves of member 22 are aligned with the ribs and grooves of member 20. Thus, a locked position of the fastener can be effected at each point where the ribs and grooves of member 22 are aligned with the ribs and grooves of member 20. Thus, a ratchet-like relationship is achieved in which members 12 and 14 can be rotated in either direction relative to each other until the desired degree of spacing between the two is achieved. Members 12 and 14 may be locked at the desired spacing by aligning the ribs and grooves of member 22 with the ribs and grooves of member 20. The cutting away of opposite corners of members 12 and 14 as seen in FIG. 1 forms grip-like structures which facilitate movement of the members 12 and 14, especially when they are in a position locked closest to each other.

As discussed, one or both of the two relatively rotating rib and groove structures may be resilient. The resilient ribs and grooves may be formed from a plastic material. Member 22, if chosen to have resilient ribs, could be formed by injection molding of a plastic having wear resistant and resilient properties. Alternatively, the core of member 22 could be made from any material desired, preferably an inexpensive material such as a hollow plastic member, and the ribbed portion could be produced separately and adhered to the core of member 22. The ribbed portion may be produced by molding a sheet of ribbed material and cutting a strip from the sheet which would fit around the core and adhering it to the core with a proper adhesive. Additionally, the ribbed portion may be molded or formed into a sleeve-like member with ribs which is slid over and adhered to the core member. If member 20 is chosen to have resilient ribs its ribs may be formed in any of the various methods discussed above.

Alternatively, one of the ribbed and grooved structures may be chosen to be of the resilient type and the other ribbed and grooved structure may be rigid. For example, the ribs 26 of member 22 may be resilient and the ribs and grooves 28 of member 20 may have a rigid structural integrity. In such a case, as members 20 and 22 are rotated relative to each other, ribs 26 would deform against the rigid ribs 28 of member 20 and then spring back into the grooves 28 of member 20 at each rotational point at which the ribs 26 align with grooves 28, thus providing a ratchet-like structure in which members 12 and 14 could be variably held with respect to each other.

Rigid ribs could be made by forming and shaping a hard material such as metal of various types or an alloy or by casting various metals or alloys into a rib and groove arrangement. This rigid rib and groove arrangement can be applied to either female component 20 or male component 22 and used in connection with a resilient rib and groove arrangement formed by any of the various processes described.

Figure 4:
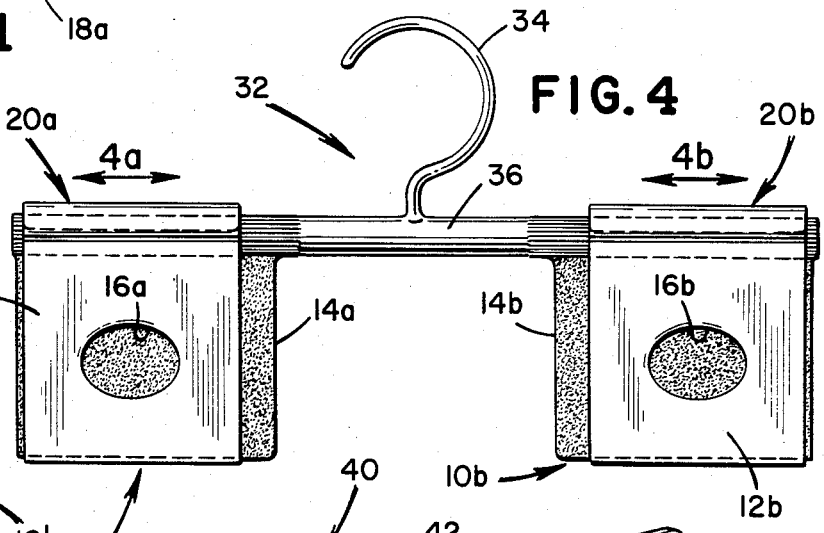
FIG. 4 is a perspective of a slightly modified form of a fastener incorporating the hinge structure of the present invention.

FIG. 4 shows a slightly modified version of the hanger seen in FIG. 1, in this embodiment, two ratchet-like hinge structures according to the present invention are used to provide variable positioning capacity for two fasteners on a single hanger. One plate of each fastener is extended beyond its opposing plate to facilitate movement of the fastener plates.

Figure 5:
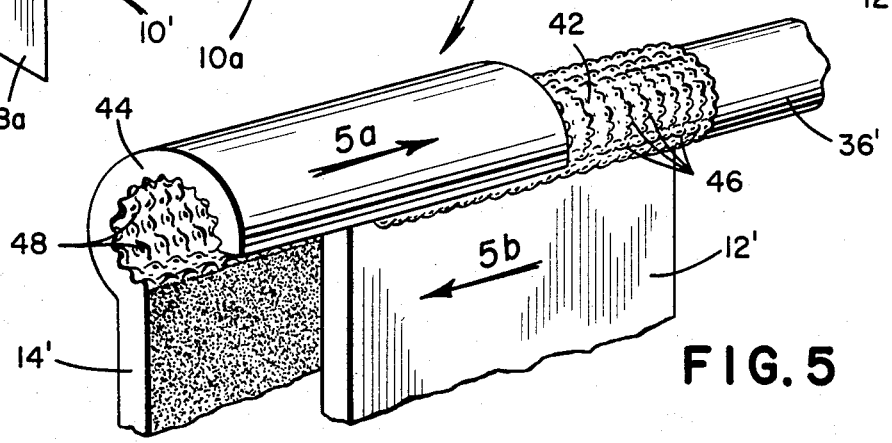
FIG. 5 shows a modified form of the hinge structure.

Referring to FIG. 5, a slightly different embodiment of the present invention is represented. In this embodiment, the previously seen rib and groove arrangements are replaced by bump-like structures spaced at regular intervals. In this embodiment, like the embodiment in FIG. 1, the bump-like structures 46 on the male component 36' and/or the bump-like structures 48 on female component 44 may be constructed from a resilient wear resistant material. When the male and female components are rotated relative to each other the resilient bump-like structures will be deformed as they are rotated against an opposing bump-like structure and will expand back to their original form when not being rotated against a corresponding bump-like structure. Thus, much like the embodiment seen in FIG. 1, a ratchet-like mechanism is achieved in which a rotational position between the male and female components is secured when the bump-like structures are expanded between the bump-like structures of the opposing component. As the embodiment seen in FIG. 1, the bump-like structures of one of the male and female components may be cast or formed from any rigid material such as metal or alloys of various types. Any of the methods of manufacture which were discussed above in relation to forming the resilient and rigid rib and groove arrangement seen in the embodiment in FIG. 1 may be used in this embodiment to form the resilient and rigid bump-like structures.

Referring to FIGS. 6, 7 and 8, an embodiment according to the present invention is seen in which the structure of the female component 54 is configured to allow maximum range of rotation between the male component 52 and the female component 54. In this embodiment, a portion 55 of female component 55 is shortened axially while a slot 59 corresponding to the axial length of portion 55 is cut into the plate extension 60 of male component 52. When the male component 52 and female component 54 are rotated relative to each other in a direction so as to increase the degree of opening between plates 60 and 62, the axially shortened portion 55 of female member 54 is guided through slot 59 so that rotation between plates 60 and 62 can continue to allow a maximum degree of opening between the two plates 60 and 62.

In FIGS. 9 and 10, two slightly modified embodiments of the present invention are represented. In FIG. 9, the male component 72 is hexagonal in cross section. The protruding points 76 of the hexagon acts as ridges which align with the grooves 78 of female component 74 to effect variable positioning between plates 60 and 62 in the same manner as discussed with previous embodiments.

In FIG. 10, the male component 82 is star shaped. When the protruding points of the star 86 are aligned with grooves 88 of female component 84 during various points of rotation between the male and female components, the components are received with respect to each other. The combinations of secured positions provide a variable setting effect to variably position plates 60 and 62 relative to each other as discussed in the above embodiments. FIGS. 11 and 12 are cross sectional views of the embodiments seen in FIGS. 9 and 10 with details omitted for the purpose of showing relative movement of plate 60 and 62.

FIG. 13 shows an embodiment in which the present invention is incorporated into a door hinge structure. In this embodiment, male components 90 with ribs and grooves 92 fit into female components 94 with ribs and grooves 96. Relative movement with variably locked positioning between hinge plates 90 and 93 (between the door and casing) is achieved in the same manner as discussed in the previous embodiments. These hinges may be manufactured by any of the various methods discussed above. The ribs and grooves may be replaced with bump-like structures or any other area or raised and non-raised structures.

FIGS. 15, 16 and 17 represent the incorporation of the present invention into a gate hinge. In FIG. 15, a bolt 99 is fitted with a vertically extending male component 100 having ribs and grooves 102 according to the present invention. The female component 108 seen in FIG. 17 would fit over the male component 100 and the ribs and grooves 110 of the female component and the ribs and grooves 102 of the male component 100 would provide a rotational structure capable of providing secured variably positioned degrees of opening of a gate secured in the channel 105, formed by bracket 109.

FIG. 17 represents an alternative embodiment to the embodiment seen in FIGS. 15 and 16. In FIG. 17, the male component is secured to the bracket 109 which contains the channel in which the gate is secured.

In addition to the previously described structures in which one or both sets of ridges and grooves or bumps on the male and female members deform so that male and female members may be rotated relative to each other, the structure of the present invention may also be constructed so that the walls of the female member in which the grooves and ridges or bumps are dimensioned may spring outwardly to permit rotation of the male member therein. Such a structure could be made using any of various elastic type materials and by regulating the thickness of the materials to achieve desired resistance in the outward spring of the female member walls upon rotation of the male member.

Figure 3:
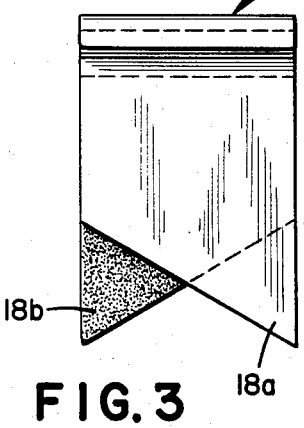
FIG. 3 is a top view showing the back fastener shown in FIG. 1 with the hanging eye omitted.
Figure 18:
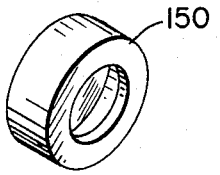
FIG. 18 is a view of a retainer used with one embodiment of the present invention.
Figure 19:
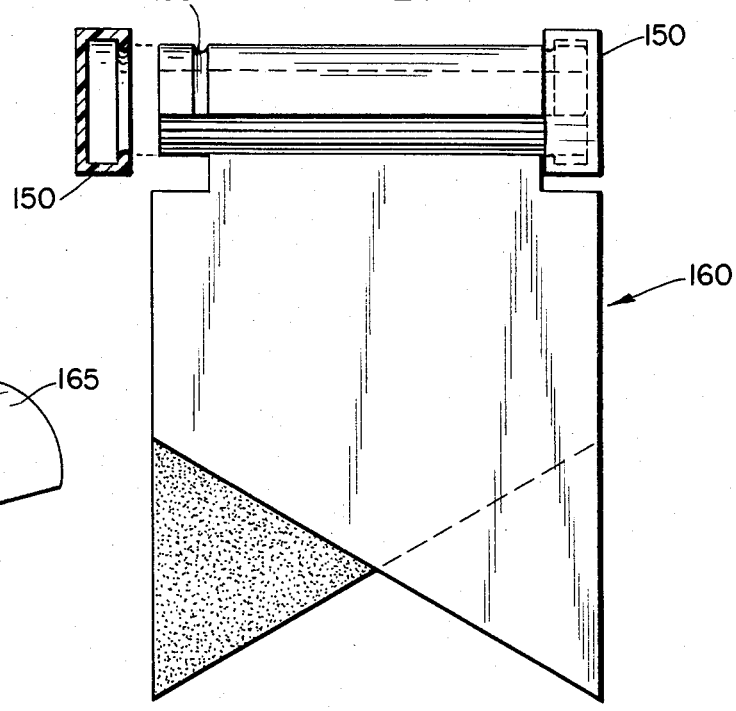
FIG. 19 is a view of one embodiment of the present invention.
Figure 20:
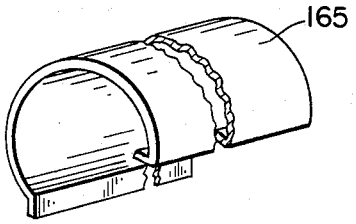
FIG. 20 is a view of a retainer used with one embodiment of the present invention.
Figure 21:
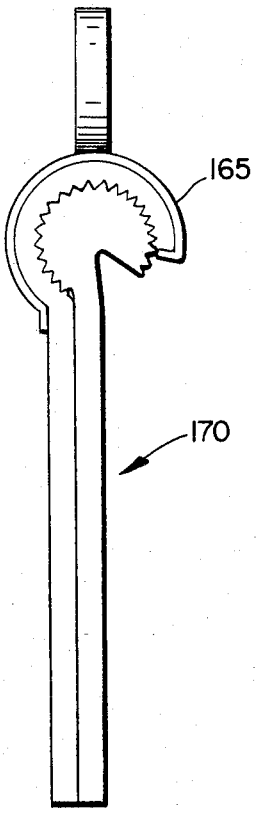
FIG. 21 is a view of one embodiment of the present invention.
Figure 22:
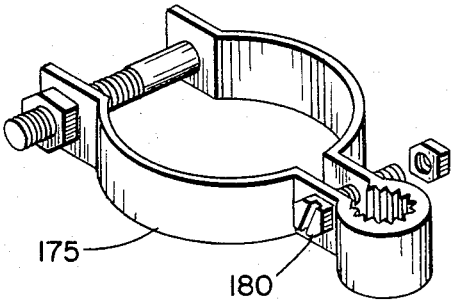
FIG. 22 is a view of one embodiment of the present invention.

FIGS. 19, 21 and 22 show structures corresponding to those seen in FIGS. 3, 1 and 16 respectively in which the female member is configured to spring outwardly so that rotation of the male member therein may be achieved. Additionally, it is contemplated that retainers may be used with the structures to regulate the degree of resistance to outward spring of the female members so that the resistance to relative movement between the male and female members can be regulated. For example, a retainer 150 as shown isolated in FIG. 18 may be used in conjunction with the hinge structure of the present invention shown in FIG. 19. The retainer 150 is a ring structure which is slid along the exterior of the female member and fits in a groove 155 provided in the exterior wall of the female member and thereby provides resistance to outward spring of the female member. FIG. 20 shows another type retainer 165 which may be used as shown in FIG. 21. This retainer 165 is made of a spring-like material that can be configured in any length. The fastener is slid over the exterior of the female member to provide an inward biasing force which regulates the resistance of the female member to outward spring. FIG. 22 shows a fastener 175 with outwardly springing female walls. Resistance to the outward spring may be regulated by a bolt and nut structure 180.

It is understood that these hinges can take the form of any of the various embodiments discussed above and also be manufactured by any of the various methods discussed, as well as numerous other known methods.

The foregoing discussion fully reveals the essence of the present invention. The present invention could be readily adapted to various applications such as auto sun visors, auto gas tank access covers, hinged desk lamps and other lights, hinged trays, small shelves, towel rod holders, lids for boxes and hinges for cabinets without departing from the scope of the present invention. The foregoing list is merely exemplary of many applications which would be apparent from a reading of this specification and is not intended to limit the scope of the invention.

What is claimed is:

1. A variable position hinge structure comprising a male member with a first set of raised and non-raised portions, a female member with a second set of raised and non-raised portions, said female member having a slit to permit radial expansion and contraction of said female member, a portion of said first set of raised and non-raised portions meshing with a corresponding portion of said second set of raised and non-raised portions at various positions of relative rotation between said male member and said female member, at least one of said first and second sets of raised portions and non-raised portions being resiliently deformable to permit relative rotation between said male member and said female member.

2. A hinge structure in accordance with claim 1, wherein said first and second sets of raised and non-raised portions comprise an arrangement of ribs and grooves, said ribs and grooves being continuous in the longitudinal direction of the male and female members.

3. A hinge structure in accordance with claim 1, wherein said first and second raised and non-raised portions comprise an arrangement of bump-like structures, said bump-like structures being discontinuous in the longitudinal direction of the male and female members.

4. A hinge structure in accordance with claim 1, wherein one of said first and second sets of raised and non-raised portions is comprised of a rigid material.

5. A hinge structure in accordance with claim 1, wherein one of said first and second raised and non-raised portions comprises a set of protruding points and one of said first and second raised and non-raised portions comprises a corresponding set of grooves.

6. A variable position hinge structure comprising a male member with a first set of alternately raised and non-raised portions, a female member with a second set of alternately raised and non-raised portions, said female member having a split along its longitudinal axis to permit radial expansion and contraction of said female member relative to said male member, a portion of said first set of alternately raised and non-raised portions meshing with a corresponding portion of said second set of raised and non-raised portions at various positions of relative rotation between said male member and said female member, at least one of said first and second sets of alternately raised and non-raised portions being resiliently deformable to permit relative rotation between said male member and said female member.

7. A hinge structure in accordance with claim 6, wherein said raised portions of one of said members mesh with said non-raised portions of the other of said members.

8. A hinge structure in accordance with claim 6, wherein a number of said raised portions of one of said members is equal to a number of non-raised portions of the other of said members.

9. A hinge structure in accordance with claim 6, wherein said male member is circular in cross section, said female member is circular in cross section, said cross section of said female member being slightly larger than said cross section of said male member.

10. A variable position hinge structure comprising a male member with a first set of raised and non-raised portions, a female member with a second set of raised and non-raised portions, said female member having a slit to permit radial expansion and contraction of said female member, at least a portion of said first set of raised and non-raised portions meshing with at least a corresponding portion of said second set of raised and non-raised portions at various positions of relative rotation between said male member and said female member, said female member being elastically deformable to permit relative rotation between said male and female members.

11. A variable position hinge structure according to claim 10, further comprising a retaining member which at least partially surrounds the female member for prohibiting elastic deformation of said female member, thereby prohibiting relative rotation between said male member and said female member.

12. A variable position hinge structure according to claim 11, wherein said retaining member may be loosened without being removed to permit relative rotation between said male member and said female member.

* * * * *